United States Patent [19]

Hartig

[11] Patent Number: 4,504,708

[45] Date of Patent: Mar. 12, 1985

[54] DISCONNECT SWITCH

[75] Inventor: Alfred Hartig, Essen, Fed. Rep. of Germany

[73] Assignee: Ruhrtal-Elektrizitätsgesellschaft Hartig GmbH & Co., Essen, Fed. Rep. of Germany

[21] Appl. No.: 558,957

[22] Filed: Dec. 7, 1983

Related U.S. Application Data

[62] Division of Ser. No. 476,358, Mar. 17, 1983.

[30] Foreign Application Priority Data

Mar. 17, 1982 [DE] Fed. Rep. of Germany ..... 3209667
Sep. 24, 1982 [DE] Fed. Rep. of Germany ..... 3235379
Sep. 24, 1982 [DE] Fed. Rep. of Germany ..... 3235380

[51] Int. Cl.[3] ..... H01H 31/36
[52] U.S. Cl. ..... 200/48 V; 200/337
[58] Field of Search ..... 200/48 V, 48 P, 48 SB, 200/48 CB, 49, 153 D, 337, 48 KB; 211/202; 52/109; 74/521

[56] References Cited

U.S. PATENT DOCUMENTS 893,694 7/1908 Allenson ..... 74/521
3,036,168 5/1962 Bagnagatti ..... 200/48 V
3,755,634 8/1973 Bachler et al. ..... 200/48 V
4,297,795 11/1981 Licari ..... 211/202

*Primary Examiner*—John W. Shepperd
*Assistant Examiner*—Renee S. Kidorf
*Attorney, Agent, or Firm*—Karl F. Ross; Herbert Dubno

[57] ABSTRACT

A switch for making and breaking a connection between a load circuit and a power line, with two parallelogrammatic linkages terminating in scissorlike contactor pairs, has limitedly swivelable and/or extensible cross-links interconnecting aligned pivotal junctions of the two linkages to provide them with a certain relative mobility. In an operating position, part-cylindrical armatures detachably secured to the two contactor pairs grip respective portions of an elongate countercontact fixedly suspended between a pair of rings attached to the power line, this countercontact comprising a metallic supporting tube also provided with part-cylindrical armatures in the region of the contactor pairs. Each armature may comprise several metallic layers on a base of copper, namely an inner layer of silver, a protective layer of tin on top thereof, and an outer silver layer. The armatures could also be made, at least in part, of a scorchproof material such as silver/cesium oxide.

5 Claims, 6 Drawing Figures

DISCONNECT SWITCH

This application is a division of application Ser. No. 476,358 filed Mar. 17, 1983.

FIELD OF THE INVENTION

My present invention relates to an electrical disconnect switch of the type designed to isolate a power line from a load circuit upon separation of a movable contact element from a stationary contact element normally engaged thereby.

BACKGROUND OF THE INVENTION

Switches of this type are usually disposed in series with a power switch in the load circuit so that their own contact-closing and contact-opening operations occur under virtual open-circuit conditions. A group of such switches may be used, for example, to connect the open power switch to any one of several associated supply lines in order to establish a selected current path for a given load. These switches also serve to indicate, by their readily observable position, whether or not a particular circuit is connected to the power line or disconnected therefrom.

Even though a switch of the kind here considered opens and closes in the absence of load current, it may still be traversed by residual commutation or capacitive currents at relatively low voltage giving rise to unavoidable arcing on the opening stroke. When closed, the switch must be able to carry not only the normal load current but also, in the event of a short circuit, a greatly increased current which flows until the associated power switch is opened. The switch, of course, should always operate with a minimum contact resistance.

Since silver is a highly conductive metal, its utilization on a contact surface of a switch is well known in the art. Frequent arcing, however, is known to damage such contact surfaces as more fully discussed hereinafter.

When the disconnect switch comprises two parallelogrammatic linkages in adjoining planes forming scissor arms whose extremities constitute pairs of movable contactors designed to grip a common elongate countercontact, the engagement of the two pairs of contactors with the countercontact should be as uniform as possible. In operation, however, the load current passing in parallel through the two linkages generates an electromagnetic field subjecting these linkages to mechanical stresses and warping which may impair the engagement of their contactors with the countercontact. If the contact surfaces become temporarily separated as a result of these stresses, they can be greatly harmed by the resulting arcing under load.

OBJECTS OF THE INVENTION

The general object of my present invention, therefore, is to provide an improved switch of the character referred to in which the aforestated drawbacks are avoided.

A more particular object is to provide such a switch with highly wear-resistant contact surfaces.

It is also an object of my invention to minimize the risk of damage to these contact surfaces in a switch of the double-scissor type described above.

SUMMARY OF THE INVENTION

In accordance with an important feature of my present invention, at least one of the contact elements of such a disconnect switch comprises a metallic support to which a wear-resistant conductive armature is detachably secured for the purpose of replacement in the event of excessive wear.

Advantageously, the detachable armature is a part-cylindrical face plate overlying a peripheral surface of a supporting rod. Especially when the contact element here considered is an elongate countercontact perpendicular to the swing plane of a pair of scissor arms, as in the parallelogrammatic disconnect switch referred to, the surface portion of the supporting rod receiving the curved face plate is preferably recessed so that this face plate is substantially flush with the surface of an adjoining rod section. This minimizes any discontinuities which could give rise to corona discharges, particularly in the event of a short circuit.

Such an armature may consist of or at least include a scorchproof, nonoxidizable refractory material of suitable conductivity, specifically silver/cesium oxide or a composition known as hard silver.

Another advantageous structure for the face plate includes a plurality of relatively thin metallic layers stacked on a heavier base, preferably of copper, including an inner layer of silver overlain by a protective layer of soft, lower-melting metal. Ordinary silver, as is known, has a melting point of about 1230 K. and a boiling point of about 2473 K. When an arc causes partial melting of the silver, the melt tends to absorb ambient oxygen which escapes upon subsequent hardening of the metal; this phenomenon, known as sputtering, leaves a pocked surface. Frictional engagement of such a surface with a similarly pocked countersurface results in rapid wear of the contacts. I have found, in accordance with my present invention, that sputtering can be avoided by covering the silver layer with a protective layer of tin which melts at a much lower temperature, namely about 500 K., while its boiling point of about 3000 K. lies well above that of silver. In operation, i.e. with the switch closed, the tin layer may partly melt but will still cling to the underlying silver layer, shielding it from possible arcs and preventing oxygen absorption by the silver even if the latter should be locally heated above its melting point. The high boiling point of tin, on the other hand, eliminates the risk of possible evaporation thereof at the temperatures that may be generated.

Even though tin has a higher resistivity than silver, the small thickness of the protective layer does not significantly diminish the conductivity of the armature. In the tin layer is overlain by an outer silver layer, which is desirable not only for the lowering of contact resistance but also from the viewpoint of appearance, the pressure exerted by the opposing contact element upon the armature in the closed switch position will virtually displace the tin in the zone of engagement so that the current path will pass practically directly from one silver layer to the other. The outer silver layer will also be protected against overheating by the intermediate tin layer whose melting converts sensible heat into latent heat.

In order to minimize its resistance, the tin layer ought to have a thickness of not more than about $10\mu$, preferably on the order of $1\mu$. The two silver layers, on the other hand, could be considerably heavier and may have thicknesses up to about 30μ, preferably on the order of 10μ.

I have further found, in accordance with another feature of my invention, that the aforestated problem of objectionable stressing of the parallelogrammatic linkages of a double-scissor switch can be largely overcome by interconnecting corresponding pivotal junctions of these linkages by transverse spacers in the form of supple cross-links enabling limited relative motion of these linkages. Thus, the spacers may engage the pivotal junctions by deformable couplings which could be designed as telescoped and/or swivel joints,. Advantageously, the spacers include dielectric inserts preventing the flow of cross-currents therethrough; these inserts may be designed as elastic linings or dampers providing a cushioning effect.

BRIEF DESCRIPTION OF THE DRAWING

The above and other features of my invention will now be described in detail with reference to the accompanying drawing in which.

SPECIFIC DESCRIPTION

Figure 1:
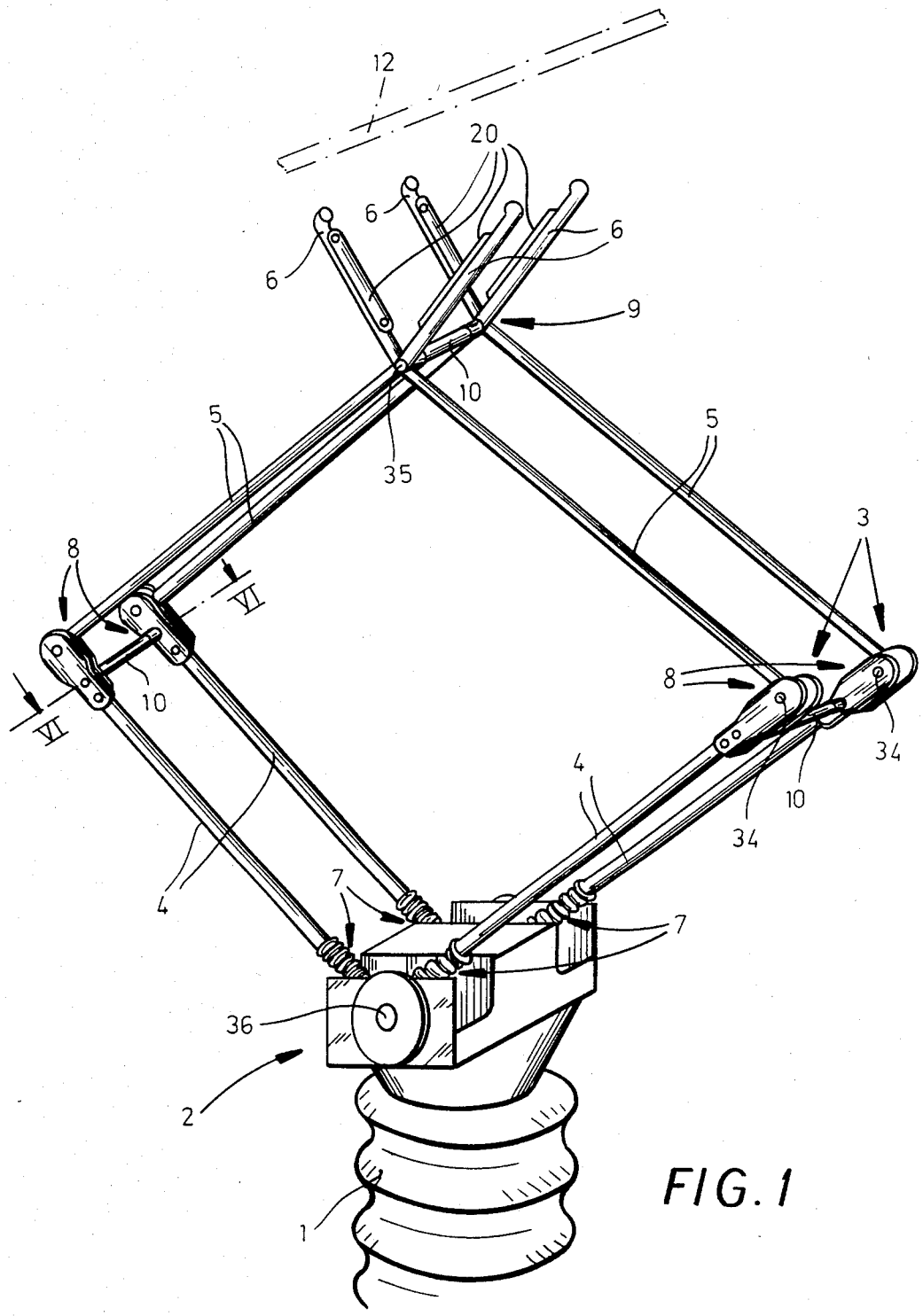
FIG. 1 is a perspective view of a double-scissor switch embodying my invention.

FIG. 1 shows a representative portion of a disconnect switch of the double-scissor type comprising a support 1, traversed by nonillustrated wiring extending to a load circuit, which carries a conventional driving unit 2 for selectively extending and retracting two parallelogrammatic linkages 3 disposed in adjoining vertical planes. Each linkage 3 comprises two scissor arms 5 and two coacting arms 4, the latter being pivoted via couplings 7 on respective shafts (not shown) of driving unit 2 coupled with a motor shaft 36 for simultaneous swinging in opposite directions. Arms 4 and 5 are articulated to each other by pivotal junctions 8; another such junction 9 interconnects the scissor arms 5 of each linkage by means of a pivot pin 35. Junctions 8, more fully illustrated in FIG. 6, comprise jaws 31 embracing the tubular arms 4 to which they are fastened by bolts 32; these jaws are pivoted to the respective arms 5 by pins 34 (FIG. 1). Extremities 6 of arms 5, projecting beyond the junction 9, form contactors designed to coact with an elongate countercontact 12 perpendicular to the planes of linkages 3. Corresponding pivotal junctions 8 and 9 of the two linkages are interconnected by respective spacers 10 forming part of supply cross-links as more fully described hereinafter with reference to FIG. 6.

Figure 5:
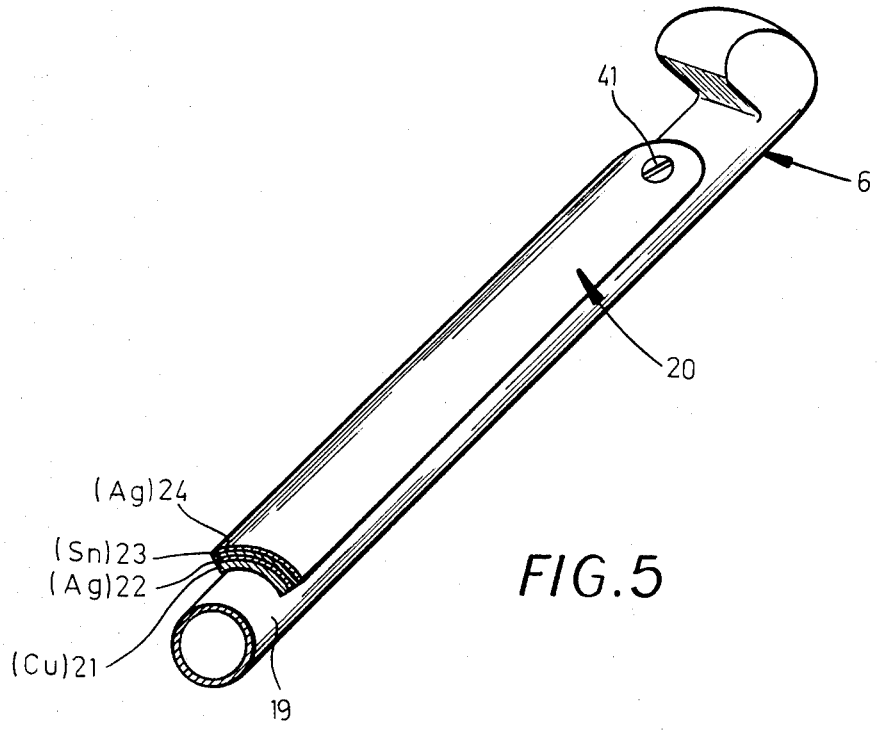
FIG. 5 is a perspective view of part of a contactor shown in the preceding Figures.

Each contactor 6, as more fully illustrated in FIG. 5, is partly designed as a tubular rod 19 which, like all the arms of linkages 3, consists of copper or other metal of suitable conductivity. The surface of rod 19 facing the countercontact 12 is overlain by an armature 20 in the form of a face plate detachably secured thereto by screws 41 (only one shown). The cylindrically curved face plate 20 consists of a stack of conductive layers, namely a relatively heavy base layer 21 of copper, an inner silver layer 22 having a thickness of about 10μ, a protective tin layer 23 overlying same with a thickness between 1 and 2μ (e.g. 1.5μ), and an outer silver layer 24 of substantially the same thickness as inner layer 22. As explained above, this composite face plate 20 has a very low contact resistance and is highly wear-resistant even when subjected to arcing when the switching is being opened. It will be apparent that existing switch arms or other contact carriers could also be fitted with such face plates.

Figure 2:
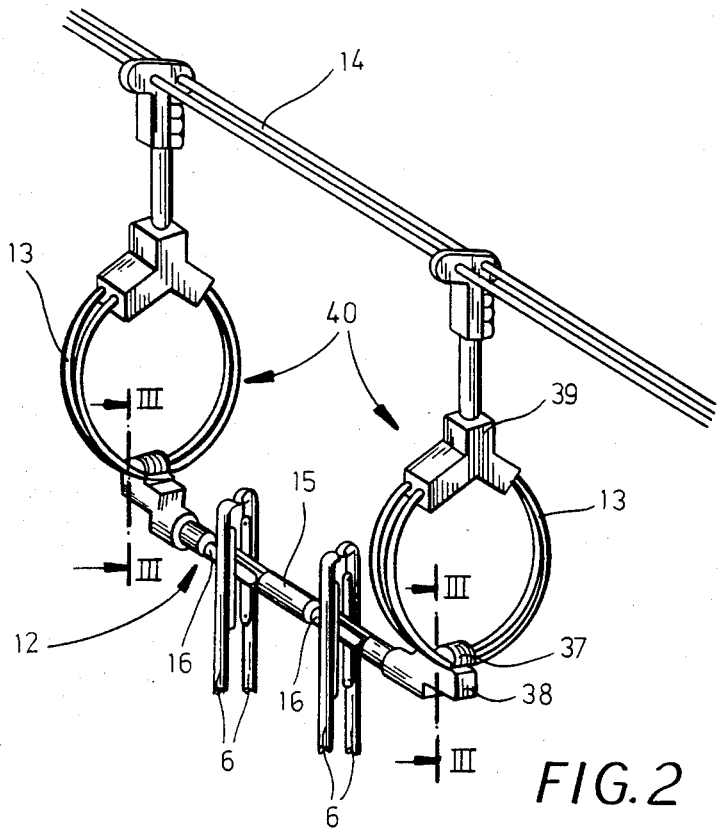
FIG. 2 is a perspective view of a power line supporting a countercontact with forms part of the switch of FIG. 1.
Figure 3:
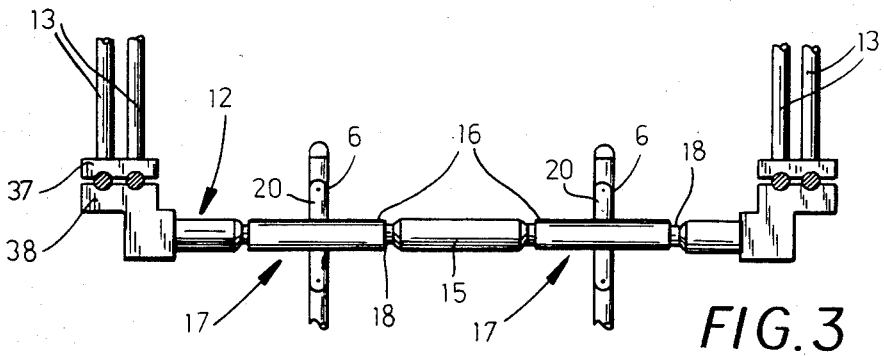
FIG. 3 is a cross-sectional detail view taken on lines III—III of FIG. 2.
Figure 4:
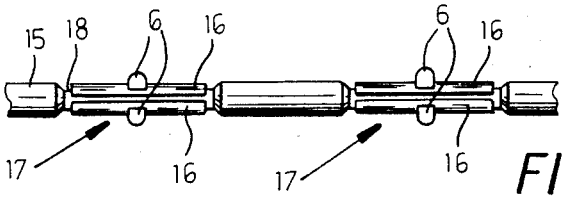
FIG. 4 is a top view of part of the assembly of FIG. 3.

The stationary countercontact 12, indicated only diagrammatically in FIG. 1, has been illustrated in greater detail in FIGS. 2–4. As seen in FIG. 2, the conductive and preferably tubular rod constituting this countercontact is suspended from a power line 14—shown as a two-conductor bus bar—by a pair of conductive hangers 40 each comprising a bifurcate member 39 to which a pair of rings 13 are anchored. The two rings 13 of each hanger are gripped between jaws 37 and 38 of a clamp attaching them to a respective end of rod 12.

A central longitudinal section 15 of this rod 12 is separated from its clamped ends by sections 18 of reduced diameter lying in zones of engagement 17 between the movable contactors 6 of the scissor arms 5 (FIG. 1). Each recess 18 accommodates an armature comprising a pair of cylindrically curved face plates 16 which may have a structure corresponding to that of face plate 20 (FIG. 5) and are fastened to the rod 12 in a similar detachable manner. Armatures 16 and/or 20 could also be made of a nonscorching conductive material such as the aforementioned silver/cesium oxide. It will be noted that the thickness of face plates 16 equals the radial depth of recesses 18 so that their outer surfaces are flush with those of midsection 15 and the adjoining end sections of rod 12. The small gaps separating these armatures from the adjoining sections could be substantially eliminated, if desired, to provide a more or less continuous peripheral surface. The relatively large outer radius of armatures 16, exceeding that of the coacting armatures 20, further diminishes the contact resistance in light of the resilient deformability of their relatively thin face plates. In the event of excessive wear, face plates 20 can be replaced without disassembling the suspension means 40 of FIG. 2.

Figure 6:
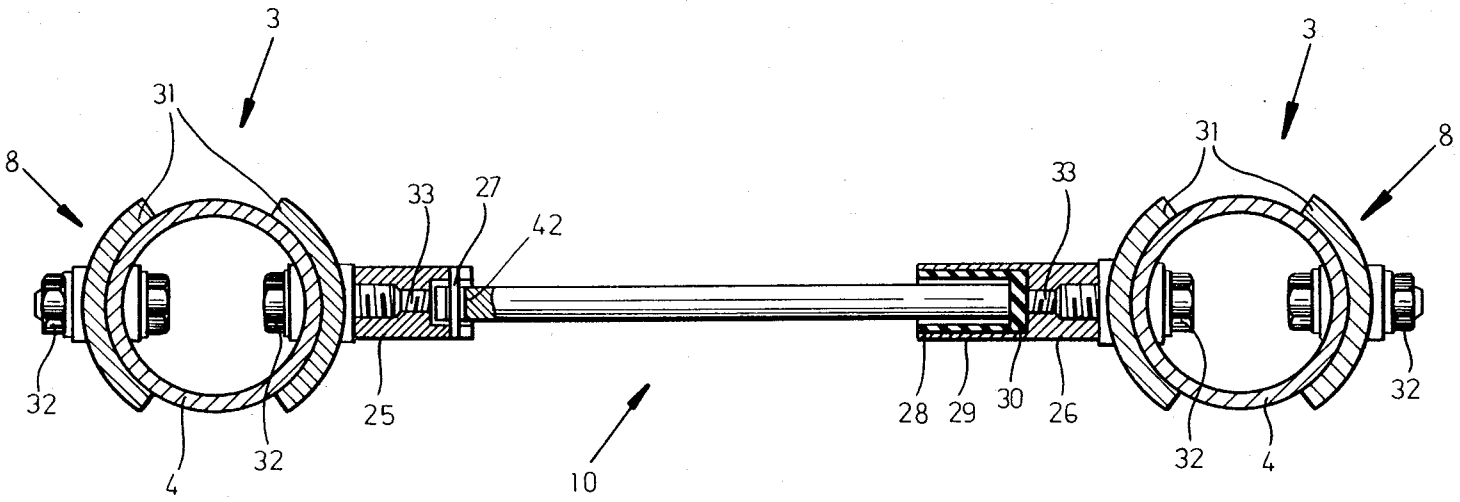
FIG. 6 is a side-elevational view, partly in section on the line VI—VI of FIG. 1 and drawn to a larger scale, of a spacer forming part of the disconnect switch.

Reference will now be made to FIG. 6 in which I have shown details of a spacer 10 interconnecting pivotal junctions 8 of the two linkages 3 of FIG. 1, this spacer being also representative of the one interconnecting the junctions 9 of the two linkages. Each end of spacer 10 is connected with the associated linkage by a deformable coupling here shown to form a swivel joint at left and a telescoped joint at right; the deformability of the coupling is in contrast to the rigidity of the elongate rod member constituting the spacer. The swivel joint comprises a sleeve 25 which is secured to the associated arm 4 of the left-hand linkage by one of the bolts 32 attaching that arm to one of the jaws 31, namely the one confronting the arm 4 of the opposite linkage; this bolt 32 engages an internal thread 33 of sleeve 25. The sleeve has a socket-shaped free end traversed by a pin 27 passing through a bore 42 of spacing rod 10 which is thus limitedly swingable about that pin within the socket and is also somewhat shiftable along pin 27. The telescoped joint at the opposite end of rod 10 comprises a sleeve 26 which is fastened to the associated arm 4 of the right-hand linkage 3 in the same manner as described above for sleeve 25 and which forms a socket 29 internally lined by a cushioning layer 28 of elastomeric material. A disk 30 of similar elastomeric material is held by the liner 28 against the bottom of socket 29. The right-hand end of spacer 10 is received with all-around clearance within liner 28 and is also longitudinally movable with reference thereto. The elastic inserts 28 and 30 furthermore act as insulators preventing the flow of cross-currents from one linkage to the other via spacer 10. Such insulation could also be used between rigidly interconnected longitudinal sections of the spacer itself, e.g. when both ends thereof are connected with the corresponding linkages by respective swivel joints of the type shown at left in FIG. 6. Even in the latter case, a certain relative transverse displacement of the linkages (in the longitudinal direction of the spacer) would be possible on account of the loose fit of pin 27 in bore 42. It should further be noted that the telescoped joint shown at right likewise permits a limited relative swinging of the spacer rod in any direction, thanks to the radial clearance of liner 28 and its compressibility, so that each of these two couplings can be regarded as a type of universal joint. Thus, they are readily interchangeable with each other; the illustrated combination of a telescopic joint and a swivel joint at opposite ends of a spacer is, however, particularly advantageous because of the greater relative mobility it confers upon the two linkages.

I claim:

1. In an electrical switch comprising a pair of parallelogrammatic linkages disposed in two parallel planes, each of said linkages including a pair of scissor arms terminating in contactors operable to grip an elongate countercontact transverse to said planes, the scissor arms of each linkage being articulated to each other and to a pair of coacting arms by respective pivotal junctions, at least one pair of corresponding junctions of said linkages being interconnected by spacing means for simultaneous displacement of the respective scissor arms relative to said countercontact, the improvement wherein said spacing means comprises a substantially nondeformable rod member engaging said corresponding junctions by means of couplings with enough play to permit limited relative motion of said linkages in at least one dimension.

2. A switch as defined in claim 1 wherein at least one of said couplings is a telescoped joint including a socket with an elastic lining facilitating relative motion of said linkages both transverse and parallel to each other.

3. A switch as defined in claim 1 wherein at least one of said couplings is a swivel joint.

4. A switch as defined in claim 1 wherein said spacing means is provided with a dielectric insert preventing the flow of cross-currents therethrough.

5. A switch as defined in claim 1 wherein each of said couplings comprises a socket surrounding a respective end of said rod member with all-around clearance.

* * * * *